US010518329B2

(12) United States Patent
Han et al.

(10) Patent No.: US 10,518,329 B2
(45) Date of Patent: Dec. 31, 2019

(54) METHOD OF MAKING NANOCRYSTALLINE METAL FLAKES AND NANOCRYSTALLINE FLAKES MADE THEREFROM

(71) Applicant: Purdue Research Foundation, West Lafayette, IN (US)

(72) Inventors: Qingyou Han, West Lafayette, IN (US); Fei Yin, West Lafayette, IN (US); Milan Rakita, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 295 days.

(21) Appl. No.: 15/373,585

(22) Filed: Dec. 9, 2016

(65) Prior Publication Data

US 2017/0165756 A1 Jun. 15, 2017

Related U.S. Application Data

(60) Provisional application No. 62/266,444, filed on Dec. 11, 2015.

(51) Int. Cl.
*B22F 1/00* (2006.01)
*B22F 9/04* (2006.01)

(52) U.S. Cl.
CPC ..... *B22F 9/04* (2013.01); *B22F 1/0055* (2013.01); *B22F 2009/045* (2013.01); *B22F 2304/10* (2013.01); *B22F 2304/15* (2013.01); *B22F 2998/10* (2013.01)

(58) Field of Classification Search
None
See application file for complete search history.

(56) References Cited

FOREIGN PATENT DOCUMENTS

CN 104148656 A * 11/2014

OTHER PUBLICATIONS

CN-104148656-A English Translation (Year: 2014).*

* cited by examiner

*Primary Examiner* — Anita Nassiri-Motlagh
(74) *Attorney, Agent, or Firm* — Purdue Research Foundation

(57) ABSTRACT

A method of producing flakes containing nanostructures from a part made of a material. The method includes subjecting the part made of the material to peening by shots driven by ultrasonic energy for a period of time, wherein nanostructures form on the surface of the part and, subsequently, damage to the part caused by continued peening of the part by the shots driven by ultrasonic energy results in separation of flakes containing nanostructures from the part made of the material. Nanocrystalline flakes containing fractured surfaces, microcracks, nanograins and nanolamellae. Sensors comprising nanocrystalline flakes containing fractured surfaces, microcracks, nanograins and nanolamellae.

17 Claims, 10 Drawing Sheets

METHOD OF MAKING NANOCRYSTALLINE METAL FLAKES AND NANOCRYSTALLINE FLAKES MADE THEREFROM

CROSS-REFERENCE TO RELATED APPLICATIONS

The present U.S. patent application is related to and claims the priority benefit of U.S. Provisional Patent Application Ser. No. 62/266,444, filed Dec. 11, 2015, the contents of which are hereby incorporated by reference in its entirety into the present disclosure.

TECHNICAL FIELD

This application relates to methods of making nanocrystalline metal powders and flakes from a bulk solid object using repeated striking of shots driven by using high intensity ultrasonic vibration.

BACKGROUND

This section introduces aspects that may help facilitate a better understanding of the disclosure. Accordingly, these statements are to be read in this light and are not to be understood as admissions about what is or is not prior art.

Nanocrystalline (NC) materials, with average and range of grain sizes typically smaller than 100 nm, have attracted more and more attention from the materials community for decades. Contrary to conventional coarse-grained counterparts, NC materials exhibit peculiar and interesting mechanical, physical and chemical properties such as, but not limited to, increased mechanical strength, enhanced diffusivity and higher specific heat. Due to these peculiar and interesting properties, NC materials are experiencing a rapid development in recent years for their existing and/or potential applications in a wide variety of technological areas such as electronics, catalysis, batteries, magnetic data storage, structural components and so on.

Conventional coarse-grained metal powders and flakes have been widely used in the surface coating technology and polymer composites. It has been proved that metal powders and flakes could improve the wear resistance, corrosion resistance, and scratch resistance of the coatings. In addition, metal flakes could be utilized as conductive filler to produce polymer composites used as shields against electromagnetic interference and electrically conducting thermoplastic composites. Due to the significant increase in hardness, strength and electrical conductivity of NC metals and alloys, metal powders and flakes with nanocrystalline structure hold promise for engineering applications, especially in fields such as surface coatings, polymer composites, etc.

Methods for generating NC metals and alloys generally include severe plastic deformation (SPD), mechanical alloying, electrode position, and sputtering. As one of the SPD methods, ultrasonic shot peening (USP), i.e., shot peening driven using high intensity ultrasonic vibration has the advantage of high efficiency and has been successfully used in forming nanostructures at the surface of a metallic workpiece, subjected to USP. As one of the SPD methods, ultrasonic shot peening (USP), or shot peening driven using high intensity ultrasonic vibration, has the advantage of high efficiency and has been successfully used in forming nanostructures at the surface of a metallic workpiece subjected to USP. Several published papers indicate that NC materials could be successfully generated via USP in pure iron, copper and other metals and alloys. Previously, a layer consisting of NC materials at the surface of an ultrasonic shot peened sample has been successfully generated. The research results indicated that nanograins in the size of 100 nm and nanocrystalline surface layer with the thickness of 1 μm were fabricated after USP treatment of 20 minutes. By increasing the USP treatment duration, nanograins in the size of 20 nm and nanocrystalline surface layer with the thickness of 10-20 μm were successfully produced. It should be recognized that such nanostructures were on the surface of the bulk material and were not separable from the workpiece during the manufacturing process. For the purposes of this disclosure nanograins are to be understood to be grains whose size is typically leas than about 500 nm. However, it should be understood this is not a rigid limit.

Methods capable of producing flakes or powders consisting of polycrystalline nanostructures include ball milling and rapid solidification of small liquid droplets (metallic glass) followed by annealing/heat treatment (crystallization). Large metallic powders are ball milled for many hours or even days to create nanostructures in the powders. This method, however, suffers from contamination from the interactions between the powders and the balls or the internal walls of the container. Rapid solidification methods can also lead to surface contamination during quenching of droplets.

Thus, there is unmet need to produce nanocrystalline metal powders and flakes from polycrystalline aggregates without the disadvantages of long time, high energy consumption, and contamination issues.

SUMMARY

A method of producing flakes containing nanostructures from a material is disclosed. The method includes providing a part made of the material and subjecting the part made of the material to peening by shots driven by ultrasonic energy for a period of time, wherein nanostructures form on the surface of the part and, subsequently, damage to the part caused by continued peening of the part by the shots driven by ultrasonic energy results in separation of flakes containing nanostructures from the part made of the material.

A nanocrystalline flake containing one or more fractured surfaces and microcracks is disclosed.

A sensor comprising flakes containing fractured surfaces, microcracks and nanostructures comprising nanograins and nanolamellae are disclosed.

BRIEF DESCRIPTION OF DRAWINGS

While some of the figures shown herein may have been generated from scaled drawings or from photographs that are scalable, it is understood that such relative scaling within a figure are by way of example, and are not to be construed as limiting.

FIG. 6 is a bright field TEM characterization image of the microstructure of the metallic flakes.

DETAILED DESCRIPTION

Figure 1:
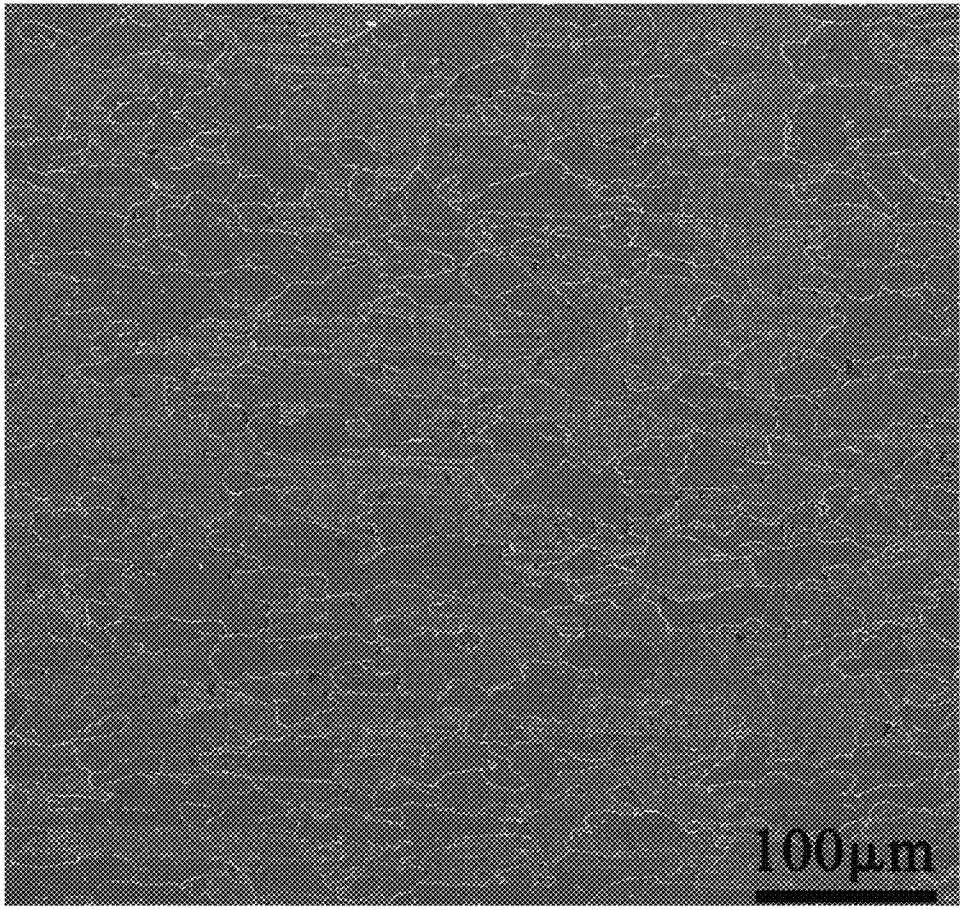
FIG. 1 shows microstructure of the AISI-1018 steel without annealing heat treatment.

For the purposes of promoting an understanding of the principles of the disclosure, reference will now be made to the embodiments illustrated in the drawings and specific language will be used to describe the same. It will nevertheless be understood that no limitation of the scope of the disclosure is thereby intended, such alterations and further modifications in the illustrated device, and such further applications of the principles of the disclosure as illustrated therein being contemplated as would normally occur to one skilled in the art to which the disclosure relates.

In the present disclosure a method to generate Nano-Crystalline (NC) metal flake by Ultrasonic Shot Peening (USP) is described and the mechanism for the formation of NC metal flake via this method was analyzed and discussed. In experiments leading to this disclosure, nanostructured metallic powders/flakes were successfully produced by severely ultrasonic shot peening. Surface nanocrystallization of the material was realized and then the fabricated nanostructured surface layer was impacted in-situ by the subsequently ultrasonic shot peening. The repeated impacts on the nanostructured surface layer result in the fracture of the materials and the formation of the metallic powders and flakes due to the significant drop of the ductility and work-hardening of the nanostructured surface layer. It should be recognized that when such fracture occurs flakes and powder are produced simultaneously, their proportion being dependent on the shot peening time and vibration frequency. For purposes of this disclosure, particles greater than about 100 micrometers in size can be termed as flakes, while smaller particles can be assumed to be constituents of powders. Transmission Electron Microscope (TEM) observations indicated that the generated metallic powders and flakes contain nanograins with the size in the range from 20 nm to 100 nm. Micro-crack initiation and propagation were also characterized at the topmost nanostructured surface layer. Research results suggested that the mechanism for the formation of the nanostructured metallic powders/flakes during the ultrasonic shot peening includes the stages of surface nanocrystallization and fracture of the fabricated nanocrystalline surface and ultrasonic shot peening can be potentially used as an effective method to produce nano-structured metallic powders/flakes.

Figure 2:
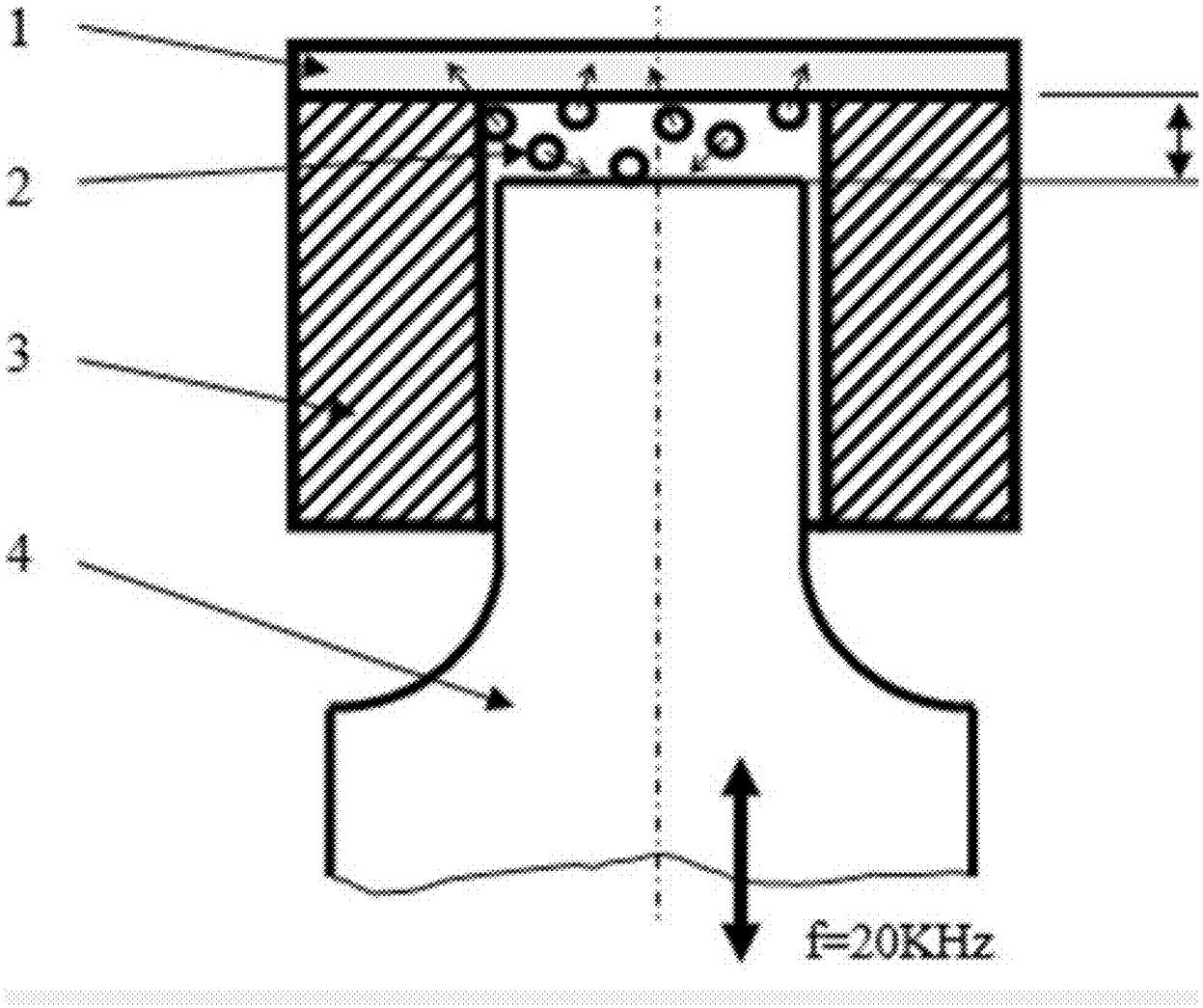
FIG. 2 is a schematic representation of the experimental set up used to obtain the results reported in this disclosure

FIG. 1 shows the microstructure of an AISI-1018 steel plate with coarse grains and a thickness of 3 mm used for some of the severe shot peening studies leading to this disclosure, without annealing heat treatment. It can be seen in FIG. 1A that the grain size is in the range of about 50 μm to 200 μm. FIG. 2 is a schematic representation of the experimental set up used to obtain the results reported in this disclosure. FIG. 2 also shows schematically the principle of the ultrasonic shot peening. Steel shots were placed on the surface of the ultrasonic horn. Referring to FIG. 2, 1 represents a metal sample, 2 are spherical shots used for shot peening, 3 is the enclosure in which the ultrasonic shot peening is conducted and 4 is the ultrasonic horn used. The ultrasonic horn 4 was connected to a transducer and generator of ultrasonic signals (not shown) of 20 kHz. Driven by the ultrasonic signal, the surface of the ultrasonic horn will be vibrated. Referring to FIG. 2, the enclosure 3 serves as an enclosure for shots and as a guide to provide vertical position of the horn 4, perpendicular to a surface of sample 1. High-pressure air is used to cool the heat generated by impacts between the shots and sample surface during ultrasonic shot peening. The specimen with the dimension of 30*30 $mm^2$ was fixed at the top of the cylindrical container with inner diameter of 20 mm. The distance between the sample and the vibration surface is 10 mm. Ultrasonic signal is created with Sonics Vibra-Cell generator, which operates at 20 kHz and is capable of producing output power up to 1.5 kW. Balls with a diameter of 6.4 mm, which are made from commercial S550 stainless steel, are used in this experiment.

In experiments leading to this disclosure, the surface layer of the bulk solid sample of AISI-1018 steel described above was severely plastic deformed by using repeatedly striking of shots driven by the high intensity ultrasonic vibration. It was found that small metal flakes begin to form after 30 minutes of ultrasonic shot peening and an apparent metal flake layer was formed at the perimeter of the shot peened area after 1 hour of USP. It should be noted that for purposes of the present disclosure alloy flakes such as those of AISI-1018 steel, are also referred to as metal flakes. It should be noted that all the microstructures and images of nanostructures shown in the figures accompanying this detailed description refer to AISI-1018 steel, a designation well understood by those of ordinary skill in the art.

The morphology of the fabricated nanostructured metallic flakes was observed by Leica optical microscope. Scanning electron microscope (SEM) observations were performed on a FEI QUANTA-3D FEG scanning electron microscope. The cross-sectional SEM specimen was first mechanically polished using diamond paste, and then etched at room temperature in a solution of 100 mL alcohol and 4 mL nitric acid. The characterization of the finer details of the microstructure in the generated metal flakes was performed using an FEI Tecnai G20 transmission electron microscope equipped with the LaB6 filament and operated at 200 kV. The specimens for TEM examination were prepared by the FIB lift-Out method using FIB/SEM Dual Beam FEI Nova 200. The bright-field (BF) TEM images as well as select pattern diffraction were taken to characterize the microstructure of the materials.

Figure 3:
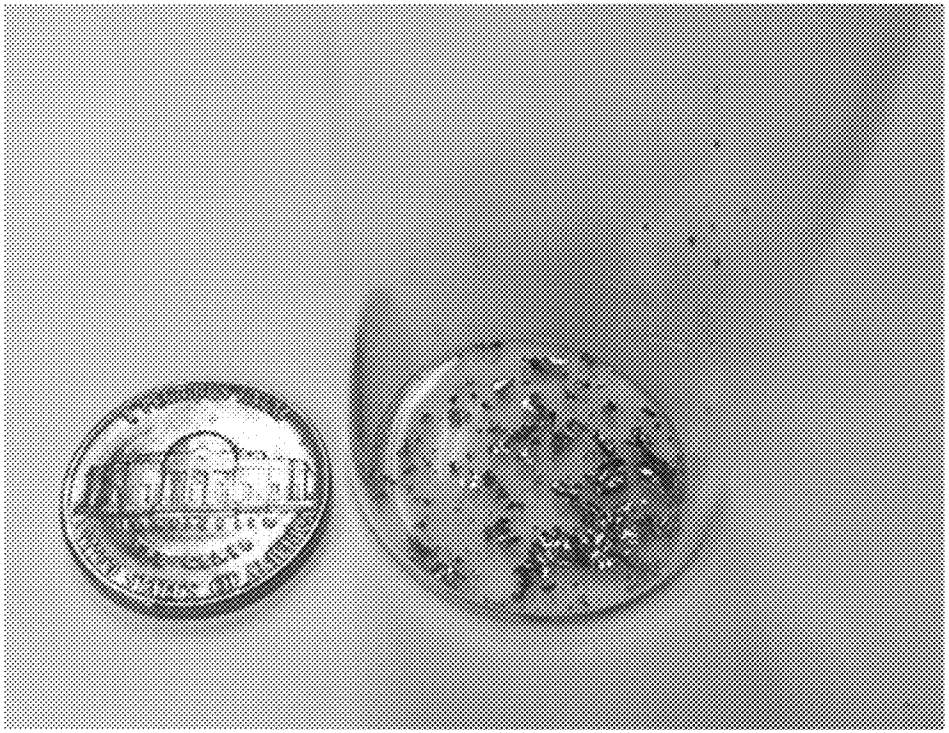
FIG. 3 shows the metallic flakes fabricated by ultrasonic shot peening
Figure 4:
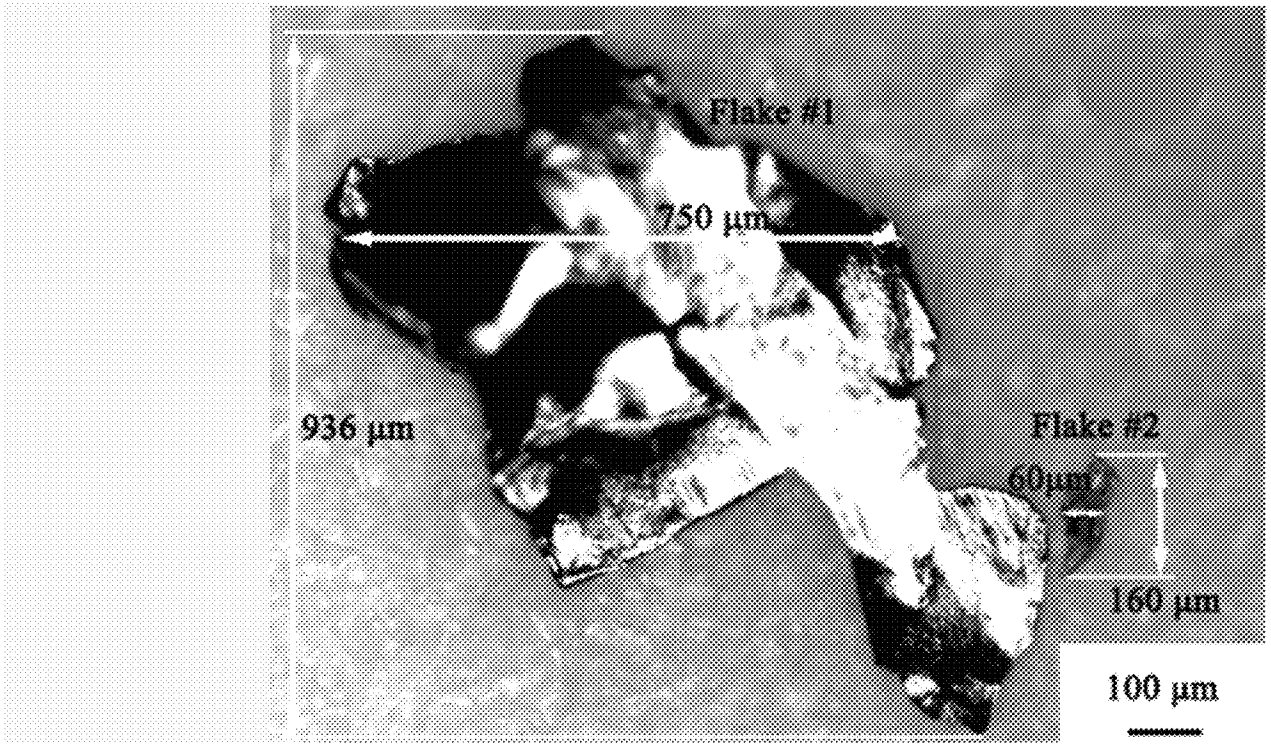
FIGS. 4 and 5 show that the size of the generated metallic flakes is in the range of tens of micrometers to hundreds of micrometers.
Figure 5:
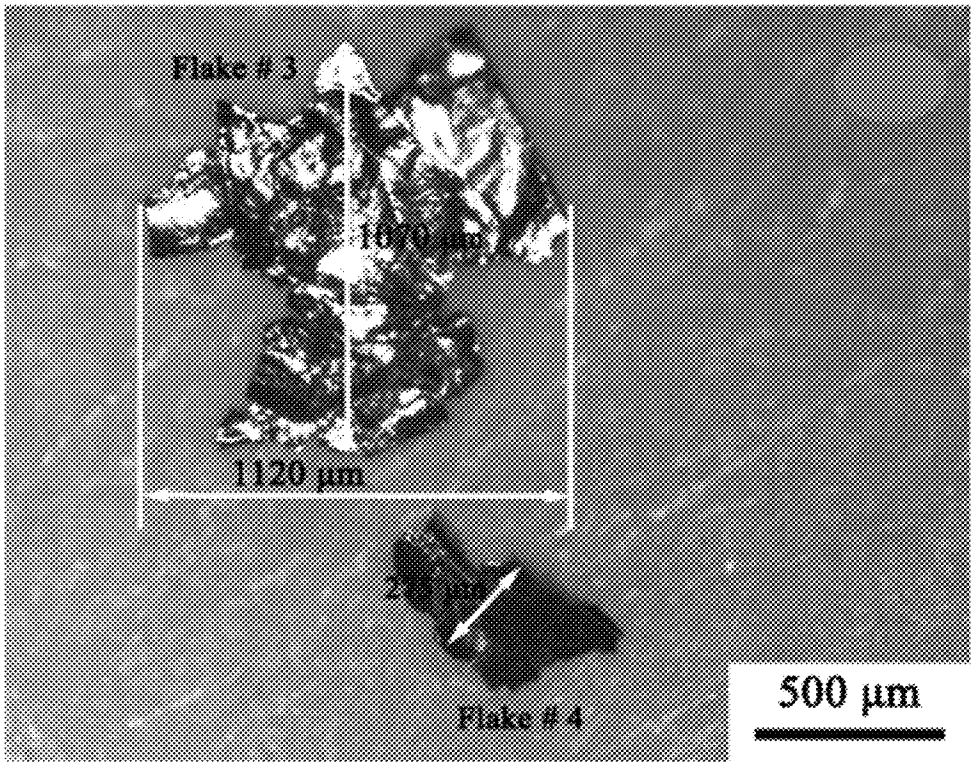

FIG. 3 shows a magnified image of the metallic flakes fabricated by ultrasonic shot peening. The shot peening duration was 60 minutes and the ultrasonic energy employed was 1.5 kW. The ultrasonic frequency used was 20 kHz. Higher frequencies and higher ultrasonic energies can improve manufacturing speed. The morphology of the metallic flakes was observed via optical microscope. FIGS. 4 and 5 show that the size of the generated metallic flakes is in the range from tens of micrometers to hundreds of micrometers. The generated metallic flakes are very clean and shiny, there are no oil and other contaminants on the surface of the metallic flakes due to the in-situ severely ultrasonic shot peening method.

Figure 6:
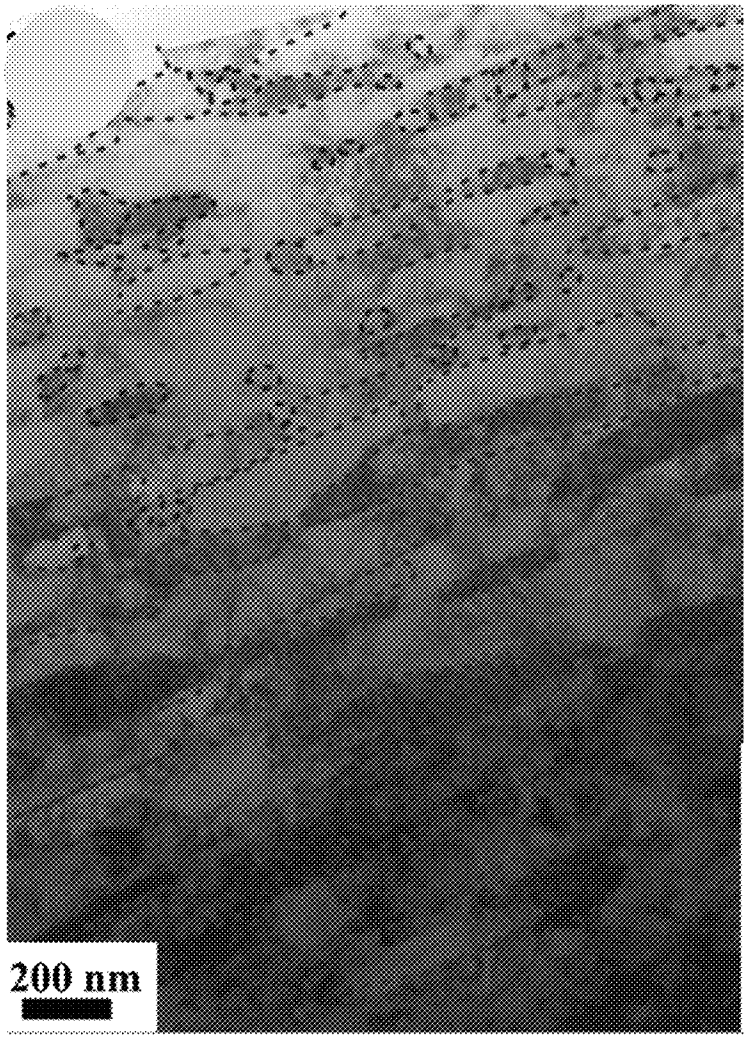
FIG. 6 shows

A TEM sample was cut from the metallic flakes by Focus Ion Beam (FIB) and lifted out via the micromanipulator equipped with Omni probe. The sample was thinned to 100 nm thickness by ion beam subsequently. FIG. 6 is a bright field TEM characterization image of the microstructure of the metallic flakes. The nanograins seen with size in the range from 20 nm to 50 nm were characterized. As indicated by dash lines in FIG. 6 the majority of the generated nanocrystalline grain is of lamellar-shaped with the almost the same orientation. And there are some smaller equiaxed grains that can be discerned in FIG. 6. High density of the grain boundary was seen in the metallic flakes. The high density of grain boundary is good for the improvement of the mechanical properties of materials because grain boundaries will terminate the movement of dislocations during plastic deformation. According to the published literatures, dislocation movements will be substantially suppressed by the extremely small grains in nano-grained (NG) materials, which accounts for the extreme strengthening in NG metals. The high density of the grain boundary will provide a large number of paths for diffusion and chemical reactions.

Figure 7:
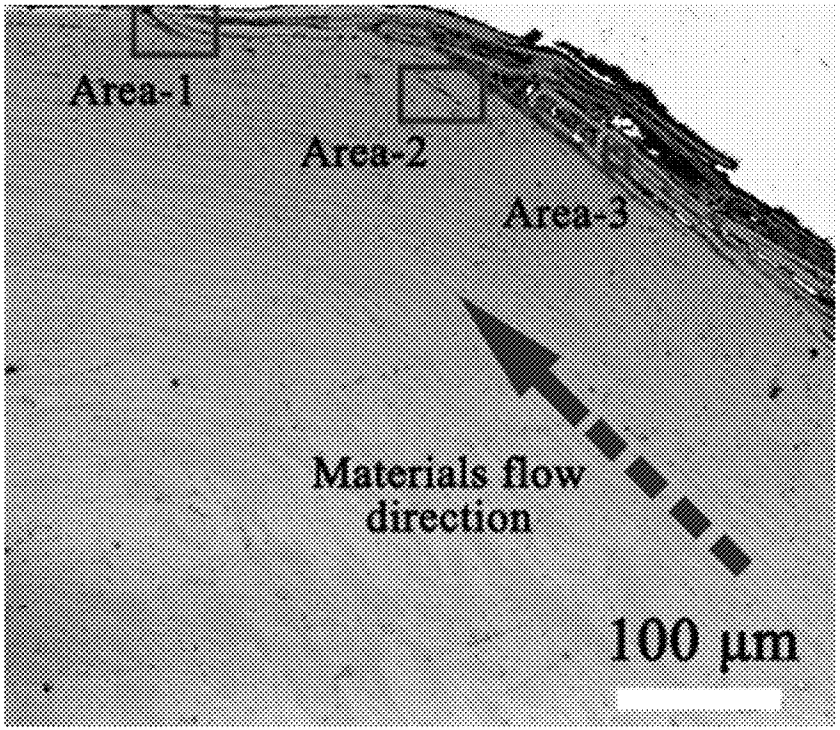
FIG. 7 shows microstructure of cross-section of the bulk AISI-1018 steel sample after shot peening as characterized by SEM.

To analyze the mechanism for the formation of the nanostructured metal flakes during severe ultrasonic shot peening, microstructure of the sample's cross-section was characterized via SEM. FIG. 7 shows microstructure of cross-section of the bulk AISI-1018 steel sample after shot peening as characterized by SEM. FIG. 7 demonstrates that the gradient nanostructured surface layer was fabricated on the severely ultrasonic shot peened sample. The grain size of the peened sample increases with the increase of the depth from the topmost surface. The nanostructured surface layer was generated at the topmost surface. The grains at the deformation layer as shown in FIG. 7 were elongated in the materials flow direction. The materials at the deformation layer have been severely plastic deformed and the materials will flow from the peened area to the un-peened area. The deformation mechanism of the materials during USP can be treated as repeatedly impact between shots and the material. The material will flow to the area free of force in the direction of the shear band. Micro-cracks and fracture of the materials can be seen at the topmost surface of the peened materials as shown in FIG. 7.

Figure 8:
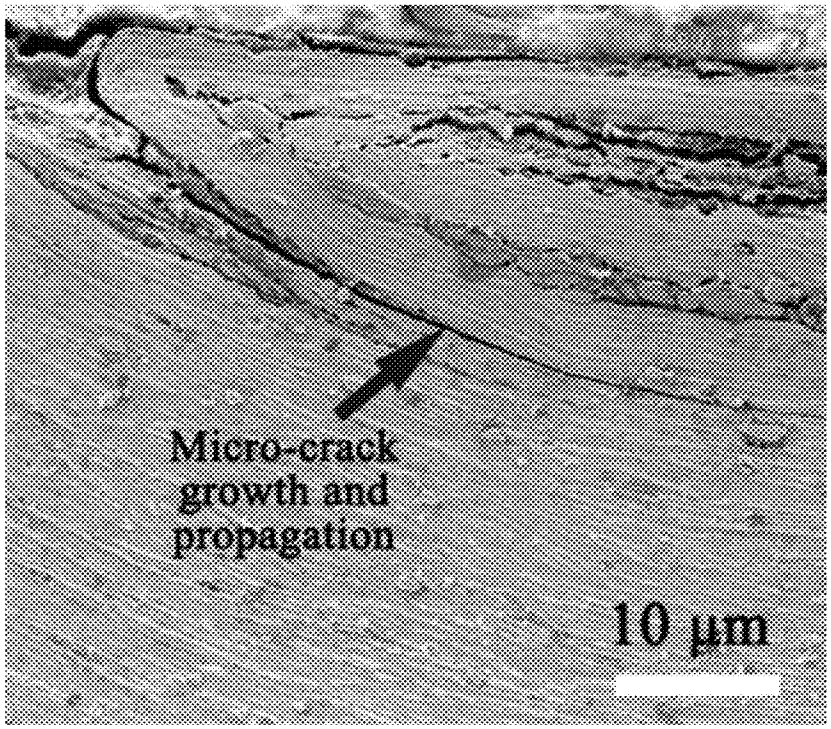
FIG. 8 shows the magnified observation of area 1 indicated in FIG. 7.
Figure 9:
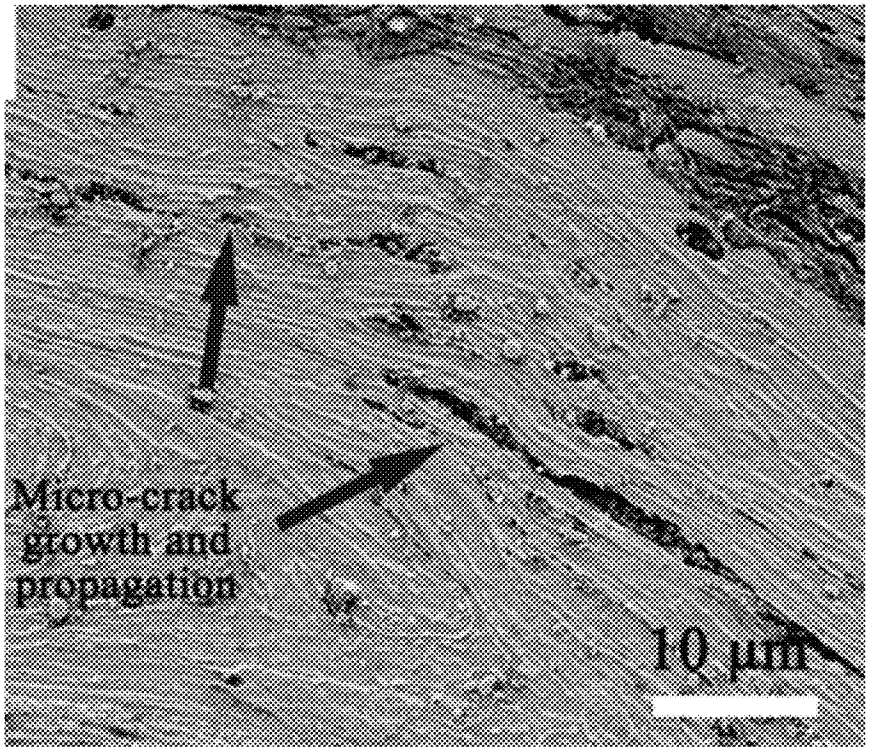
FIG. 9 shows the magnified observation of area 2 indicated FIG. 7.
Figure 10:
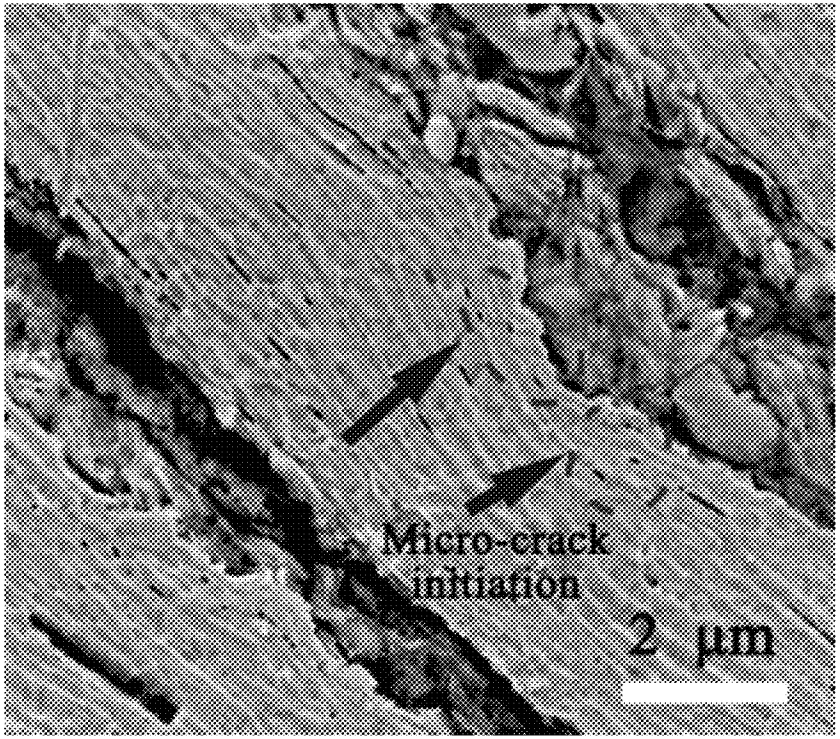
FIG. 10 shows the magnified observation of area 3 indicated FIG. 7.

To further analyze the crack initiation and propagation during USP, SEM characterizations were carried out at different positions with higher magnifications. FIG. 8 shows the magnified observation of area 1 indicated in FIG. 7. It can be seen in FIG. 8 that a long micro-crack indicated by arrow is located at the top surface of the material. The long micro-crack is generated by the fatigue behavior of the materials under cyclic stress-strain load during ultrasonic shot peening. The length of this micro-crack is about 100 micrometers and it will continue propagating until materials failure. The materials at the top surface will finally exfoliate from matrix materials if applied continues strike. FIG. 9 shows the magnified observation of area 2 indicated FIG. 7. It can be seen in FIG. 9 that the length of the micro-crack is about tens of microns, which is shorter than the crack shown in FIG. 8. FIG. 10 shows the magnified observation of area 3 indicated in FIG. 7. It can be seen in FIG. 10 that micro-cracks in the dimension of several microns or even shorter are generated at the grain boundaries. These micro-cracks will propagate longer and longer under cyclic stress-strain load and finally result in the fracture of the materials.

As shown in FIGS. 7 through 10, there are two kinds of microcracks. The first kind is the surface damage induced crack. The surface damage induced cracks were mainly found at the boarder of the peened area. The cracks initiated at the surface of the sample and penetrated into the interior of the materials. The second kind of crack is the materials defect induced cracks. This kind of cracks were mainly found in the peened area. The peened area was impacted repeatedly by the high steel shots. The materials defect such as the impurity, grain boundary will provide nuclei sits for the crack initiation under cyclic loading.

The formation of the nanostructured metallic powders/flakes via USP can be divided into two stages. The first stage is the surface nanocrystallization of the materials. At the first stage, the gradient nanostructured surface layer was fabricated due to the severe plastic deformation of the materials. The generated nanostructured surface layer has a record-high strength, however the ductility and work-hardening of the materials are decreased considerably. The second stage is the fracture of the nanostructured surface layer. At the second stage, the steel balls will continuously impact the nanostructured surface layer fabricated at the stage one. The saturation microstructure can evolve during severely ultrasonic shot peening and the grain boundary migration is the dominant process responsible for the limitation in refinement by SPD. The additional energy cannot fulfill the further grain refinement. Defects in the materials such as impurity particles and grain boundaries provide nuclei of the micro-cracks and the excessive energy will cause the crack initiation and propagation of the nanostructured layer.

Thus, in this disclosure, ultrasonic shot peening has been described to be capable of generating nanocrystalline metal flakes, which have applications in the field of surface coating and polymer composites. Excessive ultrasonic shot peening was performed on an AISI-1018 steel sample resulting metal flakes in the size range of several micrometers (100-300 micrometers). It should be noted that these flakes are irregular in shape and for purposes of this disclosure the size of a flake is taken to be the largest dimension of a flake. Transmission Electron Microscopy (TEM) was used to characterize the microstructure of generated metal flakes and lath-shaped nanocrystalline grains with average thickness of or less than 20 nm have been observed. Evidence indicates that grains will be elongated not only in the micro-scale but also in the nano-scale due to the SPD induced by USP. In addition, to study the mechanism for the formation of nanocrystalline metal flakes, microstructure of the peened sample was observed via SEM and the crack initiation, growth and propagation during USP have been characterized. The fatigue crack initiation, growth and propagation during USP was then mathematically analyzed and a mathematical model for fatigue life calculation for USP is proposed.

Based on the above description, we can now describe a method of producing flakes containing nanostructures from a part made of a material. The method comprises providing a part made of the material and subjecting the part made of the material to peening by shots driven by ultrasonic energy for a period of time. When a suitable combination of ultrasonic energy and peening time is used, as described in this disclosure, the damage to the material caused by the shots driven by ultrasonic energy results in separation of flakes from the material and the separated flakes contain nanostructures. The damage is essentially mechanical and is mostly, if not entirely, due to fatigue damage, though the impacting of the material by the shots can also have an effect in the separation of the material in the form of flakes having the composition of the material from the part. The ultrasonic energy can range from 1 to 10000 W depending on the size of the ultrasonic probe or sonotrode, while the energy density can be in the range of 20-500 W/cm$^2$. The area used for energy density calculations is the area of the surface of the sonotrode imparting the vibration to the shots. Referring to FIG. 2 this is the surface of the sonotrode presented to the shots. A range of 100 to 300 W/cm$^2$ was obtained using approximately one inch diameter cylindrical sonotrode under 1.5 kW power. It should be recognized that the sonotrode need not be cylindrical in shape. Other shapes are also possible to be deployed. Also, its should be recognized that in FIG. 2, the part or piece of a material, which is AISI 1018 steel in some embodiments, need not be rectangular or present rectangular surface for shot peening. Thus the shapes for the part and the sonotrode shown in FIG. 2 are for illustrative purposes only. In particular, the shapes can be regular or regular both for the part being shot peened and the sonotrode. Some of the experiments leading to this disclosure employed energy densities in the range of 100-300 $W/cm^2$ in some embodiments of the method and the peening time can range from 10 seconds to several hours. In several embodiments of the method, the peening time can vary between 30 min to 60 min to obtain NC surface layer and NC metal powder and flakes. In one embodiment of the method, carbon steel shots were used. Non-limiting examples of other materials that can be used as the material for the shots include metals, alloys and ceramics. It should be noted that that the peening time and the ultrasonic energy combination determines the outcome of the operation. Also, a frequency of 20 kHz was employed as the frequency for the ultrasonic vibration employed in the experiments. The frequency of 20 kHZ is exemplary and is not to be construed as limiting in the implementation of this disclosure. Other frequencies can be employed. The flakes containing nanostructures produced by the method of this disclosure contain nanograins comprising the nanostructures. Such nanograins are typically in the size range of 20-100 nm. The nanostructures contained in the flakes can include nanolamellae as described and shown in this description. The thickness of such nanolamellae is typically in the range of 30-100 nm. It should be recognized that the size ranges given for both the nanograins and the thickness of the lamellae are exemplary and are to be considered non-limiting. These ranges are influenced by the processing parameters of the method, most notably ultrasonic energy and peening time.

It is another objective of this disclosure to describe a nanocrystalline flake, defined for purposes of this disclosure as a flake containing nanostructures. Such nanocrystalline flakes are produced by the methods described above. A characteristic feature of nanocrystalline flakes produced by the methods of this disclosure is presence of one or more fractured surfaces and one or more microcracks. Nanocrystalline flakes produced by methods such as ball milling and rapid solidification do not contain a fractured surface. Further, flakes produced by the methods of this disclosure are non-spherical. The fractured surface and the non-spherical nature of these flakes both provide higher surface area and hence higher reactivity when such flakes are utilized in making composite materials and dispersions in a matrix. As demonstrated the nanocrystalline flakes, meaning flakes containing nanostructures such as nanograins and/or nanolamellae having a fractured surface can contain microcracks. These microcracks can have the advantage of providing increased surface area for flakes made by the methods of this disclosure, again providing for higher reactivity in several applications mentioned for these flakes in this disclosure. Further, as described earlier, they also contain nanograins in the size range of 20-100 nm and/or nanolamellae with thickness in the size range of 30-100 nm. These nanograins and nanolamellae impart the nanocrystalline and nanostructure nature to the nanocrystalline flakes.

Flakes produced by the methods of this disclosure that are less than 100 micrometers in size are arbitrarily termed as powder constituents and nanocrystalline powders can be formed with these flakes with sizes less than 100 micrometers. It should be noted that this size demarcation and nomenclature, namely, flakes vs. powders, is arbitrary and the methods of this disclosure are equally applicable to make flakes of all sizes. As a practical matter, in a typical implementation of the method both flakes with sizes greater than 100 micrometers as well as flakes of smaller size are produced. Thus it can be said that it is possible to generate flakes as well as powder constituents. This the method of this disclosure can be generally understood to produce flakes with nanostructures or powder particles containing nanostructures. Depending on the materials used, ultrasonic energy density and peening time employed, the size of the flakes resulting from the methods of this disclosure can be in the range of 10-1000 micrometers.

There are many applications of powders/flakes with nanostructures. These powders, made utilizing the methods of this disclosure, can be consolidated using powder metallurgy methods to make components. Nano-structured powders of metallic materials made utilizing methods of this disclosure can find applications as chemical catalysts, filler materials, etc. Nanostructured materials find applications in sensors of different varieties, especially electronic sensors and electromechanical sensors. Thus it is another objective of this detailed description to disclose electronic and electromechanical sensors utilizing flakes and powders containing nanostructures, fractured surfaces and/or microcracks, made by the methods of this disclosure.

While this disclosure describes making nanocrystalline powders and flakes of AISI steel, the method is not limited to this material. Other material to which this can method can be applied include metals. Non-limiting examples of metals to which the methods of this disclosure are applicable to include, but not limited to, Cu, Ti, Mg, Ni, Iron, Al, Co, Nb, Mo, Ta, and W. Alloys comprising one of these metals listed can also be used in this methods of this disclosure. Some of these metals listed, namely, Mo, Nb, Ta, and W are known as refractory metals. Alloys comprising one of these refractory metals listed can also be used in the methods of this disclosure. Methods of this disclosure can be used to make nanostructured flakes of steel, such as stainless steel, a non-limiting example of which is 316 stainless steel, commonly known in the steel industry.

In this disclosure, ultrasonic shot peening was successfully used to produce nanostructured metal flakes, which promise a potential application in the field of surface coating and polymer composites.) Nanostructured metallic powders/flakes consisting of the nanograins with the size in the range from 20 nm to 100 nm and the nanolamellae with the average thickness of 50 nm were fabricated by severe ultrasonic shot peening. Mechanism for the formation of the nanostructured metallic powder via ultrasonic shot peening includes the stage of surface nanocrystallization and fracture of the nano-crystallized surface layer. Thus severe ultrasonic shot peening can be potentially used as an effective method to produce nanostructured metallic powders/flakes. For purposes of this disclosure, severe shot peening is ultrasonic-vibration driven shot peening in which flakes formed separate from the part being shot peened due to mechanical damage, typically fatigue damage imparted to the part by the peening process. The severity is accomplished by factors including the ultrasonic energy density, peening time, and the nature of the material being shot peened.

While the present disclosure has been described with reference to certain embodiments, it will be apparent to those of ordinary skill in the art that other embodiments and implementations are possible that are within the scope of the present disclosure without departing from the spirit and scope of the present disclosure. It is therefore intended that the foregoing detailed description be regarded as illustrative rather than limiting. Thus this disclosure is limited only by the following claims.

What is claimed is:

1. A method of producing flakes containing nano structures from a material, the method comprising:

providing a part made of the material;

subjecting the part made of the material to peening by shots driven by ultrasonic energy for a period of time, wherein nano structures form on the surface of the part and, subsequently, damage to the part caused by continued peening of the part by the shots driven by ultrasonic energy results in separation of flakes containing nanostructures from the part made of the material.

2. The method of claim 1, wherein the ultrasonic energy density is in the range of 20-500 $W/m^2$.

3. The method of claim 1, wherein the period of time is in the range of 10 seconds to 200 minutes.

4. The method of claim 1, the material is a metal or an alloy.

5. The method of claim 4, the alloy is steel.

6. The method of claim 5, wherein the steel is a stainless steel.

7. The method of claim 1, the material is one of magnesium, copper, nickel, iron, aluminum, titanium and cobalt.

8. The method of claim 1, the material is an alloy comprising one of copper, magnesium, nickel, iron, aluminum, titanium and cobalt.

9. The method of claim 1, the material is a refractory metal.

10. The method of claim 9, the refractory metal is one of niobium, tantalum, molybdenum and tungsten.

11. The method of claim 1, the material is an alloy comprising one of niobium, tantalum, molybdenum and tungsten.

12. The method of claim 1, the nanostructures are nanograins.

13. The method of claim 12, the nanograins are in the size range of 20-100 nm.

14. The method of claim 12, wherein the nanostructures are nanolamellae.

15. The method of claim 14, wherein the thickness of the nanolamellae is in the range of 30-100 nm.

16. The method of claim 1, wherein the flakes are in the size range of 10-1000 micrometers.

17. The method of claim 1, wherein the flakes containing nanostructures are in the size range of 10-1000 micrometers.

* * * * *